US006325594B1

(12) United States Patent
Johnson et al.

(10) Patent No.: US 6,325,594 B1
(45) Date of Patent: Dec. 4, 2001

(54) SEALED DRAIN FOR ROTATING CASE PUMPS

(75) Inventors: Donald W. Johnson; David G. Schultz, Sr., both of Metairie, LA (US)

(73) Assignee: Thomas Pump & Machinery, Inc.

( * ) Notice: Subject to any disclaimer, the term of this patent is extended or adjusted under 35 U.S.C. 154(b) by 0 days.

(21) Appl. No.: 09/527,615

(22) Filed: Mar. 17, 2000

(51) Int. Cl.[7] ..... F01D 15/00
(52) U.S. Cl. ..... 415/121.3
(58) Field of Search ..... 415/88, 121.3, 415/232, 89

(56) References Cited

U.S. PATENT DOCUMENTS 4,073,294 * 2/1978 Stanley et al. ..... 128/278
5,327,862 * 7/1994 Bedi ..... 123/196 R
5,452,695 * 9/1995 Bedi ..... 123/196 A
6,092,570 * 7/2000 Densel et al. ..... 141/353
6,142,161 * 11/2000 Abbruzze ..... 134/166 R
6,216,732 * 4/2001 Apostolides ..... 137/560

* cited by examiner

*Primary Examiner*—Edward K. Look
*Assistant Examiner*—James M McAleenan
(74) *Attorney, Agent, or Firm*—Dennis A. Gross

(57) ABSTRACT

A sealed drain tool for a pump with a drain has a cylindrical tool housing. The housing has a mounting end for attaching the tool to the pump. The housing also has a free end and a bore extending longitudinally through the housing from the mounting end to the free end. The bore defines an inlet opening at the mounting end for communicating with the drain opening of the pump and has a free and opening at the free end. A plunger is slidably received within the bore. A stop element prevents the plunger from exiting the free end opening. A seal is provided between the plunger and bore adjacent the free end for preventing fluid from exiting the free end opening. A discharge opening in the tool housing permits fluid to pass from the drain of the pump through the inlet opening into the bore of the tool housing and to exit the tool housing through the discharge opening to a suitable container.

18 Claims, 3 Drawing Sheets

SEALED DRAIN FOR ROTATING CASE PUMPS

BACKGROUND OF THE INVENTION

This invention relates generally to drains for pumps, and particularly to a sealed drain for removing toxic materials from a pump.

Case pumps are known in the art and typically have a stationary outer housing or shell with an interior chamber and a rotary case therein. Typically, the rotary case has a drain hole and a plug received therein to prevent fluid from escaping. The outer stationary housing also has a drain opening. When the drain opening of the outer housing and the drain hole of the rotary case are aligned, the plug may be removed and the fluid drained from the pump cavity under force of gravity.

In some instances, these types of pumps are used to move hazardous or toxic materials. These materials pose many risks and may cause problems if exposed to the atmosphere. Therefore, the conventional method of draining such a pump is not adequate in that one cannot simply pour the hazardous material from the pump through the drain hole and drain opening into a container.

SUMMARY OF THE INVENTION

It is one object of the present invention to provide a sealed drain tool which may be utilized to drain fluid from such a case pump. Another object of the present invention is to provide a drain tool which seals against the case pump so that the drained fluid does not leak from the case pump or from the drain tool. An additional object of the present invention is to provide a drain tool which is directly connectable to a hazardous or toxic fluid collection device so that the fluid drained via the drain tool does not escape to the atmosphere. To accomplish these and other objects of the invention, a novel sealed drain tool is disclosed.

In an embodiment of the invention, a sealed drain tool for a pump having a drain opening is provided. The drain tool has a cylindrical tool housing having a mounting end which attaches the tool to the pump. The tool housing also has a free end and a bore extending longitudinally through the housing from the mounting end to the free end. The bore defines an inlet opening at the mounting end for communicating with the drain opening of the pump and a plunger opening at the free end of the housing. The tool also has a plunger slidably received within the bore. The tool also has a stop element which prevents the plunger from exiting the housing bore via the plunger opening at the free end. The tool also has a seal provided between the plunger and the bore at the free end for preventing escape of fluid from the drain tool. A discharge opening is provided on the tool housing which permits fluid to pass from the drain opening of the pump through the inlet opening and the bore of the tool and then to exit the tool housing through the discharge opening.

In an embodiment of the invention, the drain tool also has an O-ring seal in the bore at the free end which forms the seal. In an embodiment, three O-rings are provided adjacent one another at the free end which form the seal between the bore and the plunger.

In an embodiment of the invention, external threads are provided on the tool housing at the mounting end which are utilized for attaching the tool housing to the pump concentric with the drain opening.

In an embodiment of the invention, an engaging end is provided on one end of the plunger which attaches to a drain plug for removing the plug from the drain opening of the pump.

In an embodiment of the invention, a seal is provided on the mounting end of the tool housing to seal between the pump and the drain tool when attached to the pump. In an embodiment of the invention, the seal is in the form of a O-ring on the mounting end of the housing.

In an embodiment of the invention, the plunger has an elongate circular cylindrical shaft machined from a material such as steel to a first diameter and an annular shoulder machine as a part of the shaft to a second diameter. The second diameter is larger than the first diameter of the shaft and therefore defines a portion of the stop element.

In an embodiment of the invention, a method of draining a pump having a drain opening in a stationary housing and a drain outlet in a rotary case held within the housing is disclosed. The method first includes aligning the drain outlet of the rotary case with the drain opening of the housing. A drain tool is then attached to the pump at the drain opening. The tool has a cylindrical tool housing with a fluid discharge in the tool housing and a plunger received within a longitudinal bore of the tool housing. The housing of the tool is then sealed to the pump. A sealed collector is attached to the discharge for receiving the material drained from the pump. The plunger is then retreated away from the pump within the bore to permit the fluid to pass from the drain opening of the pump into the bore of the tool housing and then to exit the tool housing through the discharge into the collector.

In an embodiment of the invention, the method further includes coupling an engaging end of the plunger to a drain plug held within the drain outlet of the rotary case and then removing the drain plug by manipulating the plunger. In an embodiment, the step of removing the drain plug is done partially simultaneously with the step of retreating the plunger.

In an embodiment of the invention, the step of sealing also includes providing a seal on the mounting end of the tool housing and then threading the mounting end of the tool housing into the pump at the drain opening so that the seal is formed between the housing and the pump.

In an embodiment of the invention, the step of attaching the collector includes attaching a vacuum scrubber to the discharge in order to collect fluid evacuated from the pump.

In an embodiment of the invention, the step of aligning includes inserting an alignment device through an alignment opening in the stationary housing and into an additional alignment opening in the rotary case which serves to correspondingly align the drain outlet of the rotary case with the drain opening of the pump housing.

These and other objects, features and advantages of the present invention are described herein, and will become apparent from the detailed description of the presently preferred embodiments and related drawing figures.

DESCRIPTION OF THE PRESENTLY PREFERRED EMBODIMENTS

Figure 2:
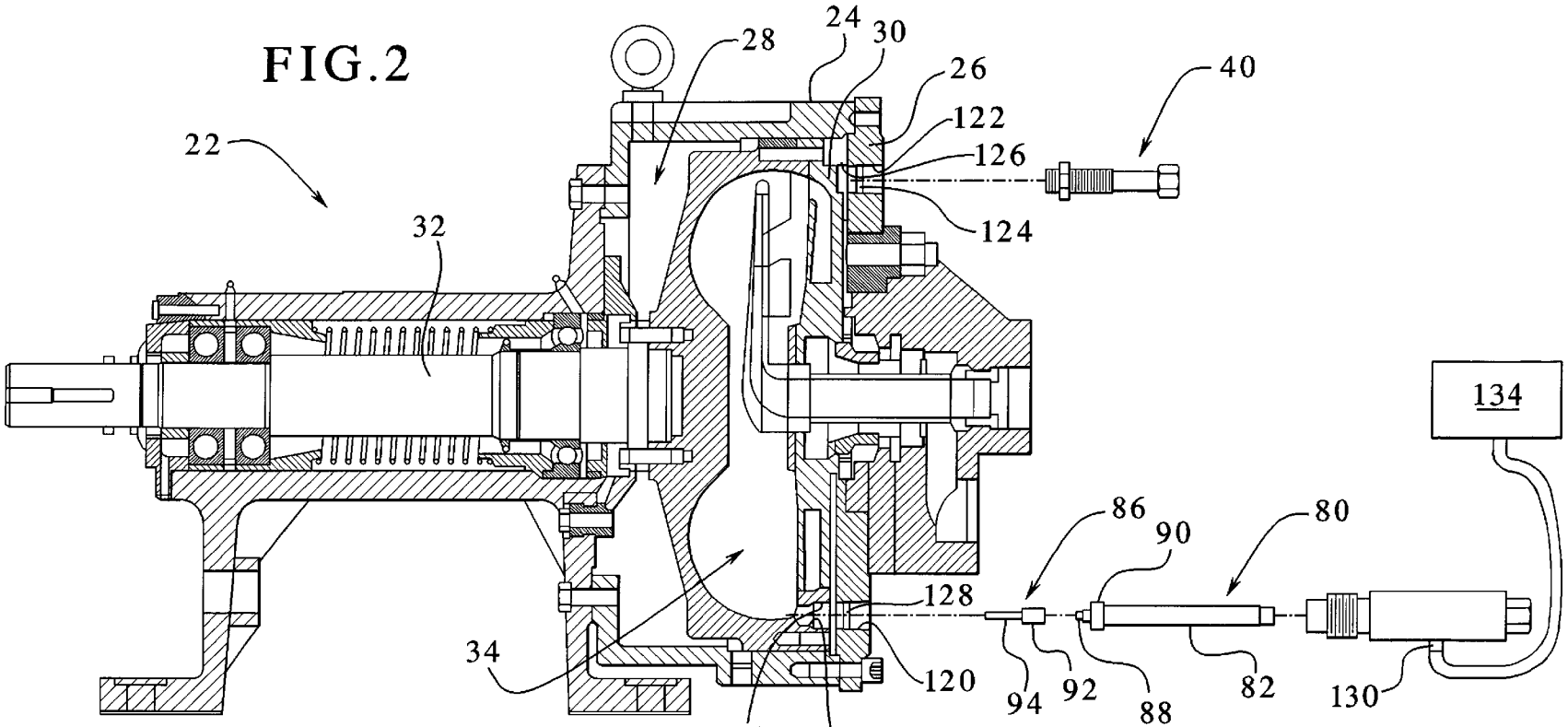
FIG. 2 illustrates an exemplary rotary case pump in partial cross section and includes the sealed drain tool of FIG. 1 in exploded view.
Figure 1:
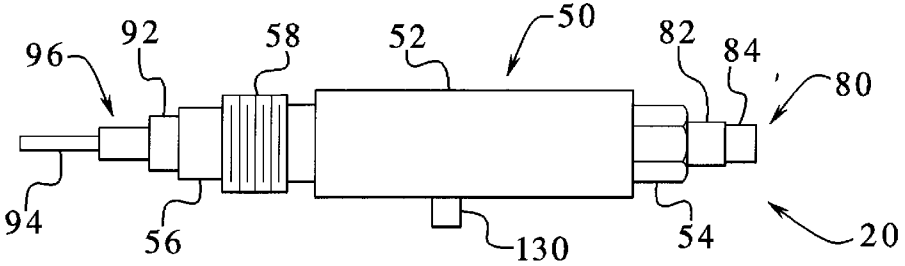
FIG. 1 illustrates a perspective view of a sealed drain tool constructed in accordance with one embodiment of the present invention.

Referring now to the drawing figures, FIG. 1 illustrates a perspective view of a sealed drain tool 20 constructed in accordance with one embodiment of the present invention. FIG. 2 illustrates an exemplary view of a rotary case pump 22 for which the sealed drain tool 20 is useful. The components of the rotary case pump 22 are described generally herein in order to provide a proper understanding of the invention.

The exemplary case pump 22 of FIG. 2 generally has a stationary housing 24 and an end cover 26 together defining a pump cavity 28 therein. A rotary case 30 is housed within the pump cavity 28 of the stationary housing 24. The rotary case 30 is typically carried on a rotary shaft 32 which is driven to rotate the case 30 within the pump cavity 28 for pumping fluid.

Such a rotary case pump 22 is sometimes used to pump fluids which include hazardous chemicals, toxic material or otherwise caustic substances which may cause severe harm to individuals, the environment or any objects with which the fluid contacts once it leaves the pump 22 and is exposed to atmosphere. It is occasionally necessary to drain such a case pump 22 and remove all of the fluid within the pump cavity 28. Typically, the rotary case also has an inner fluid chamber 34 which must also be drained of fluid.

A conventional pump 22 of this type typically includes a drain outlet 36 in the rotary case 30 which is closed off by a removable drain plug 38 received within the outlet. To drain the inner fluid chamber 34 of the rotary case 30, the drain plug 38 must be removed from the opening 36 in order that the fluid may exit the chamber. The casing 30 includes a second drain plug which is not shown in FIG. 1. However, if the fluid is of the hazardous type, it is extremely undesirable for the fluid to merely be poured into a container or awaiting vessel and exposed to atmosphere. The present invention is directed to a sealed drain tool 20 which is capable of removing the drain plug 38 and draining the hazardous fluid from the pump 22 without exposing the fluid to atmosphere or allowing the fluid to contact any objects near the pump. The present invention also includes an alignment device 40 which is used to align the appropriate openings for inserting the tool 20 and draining the fluid from the casing 30 and chamber 34.

Figure 3:
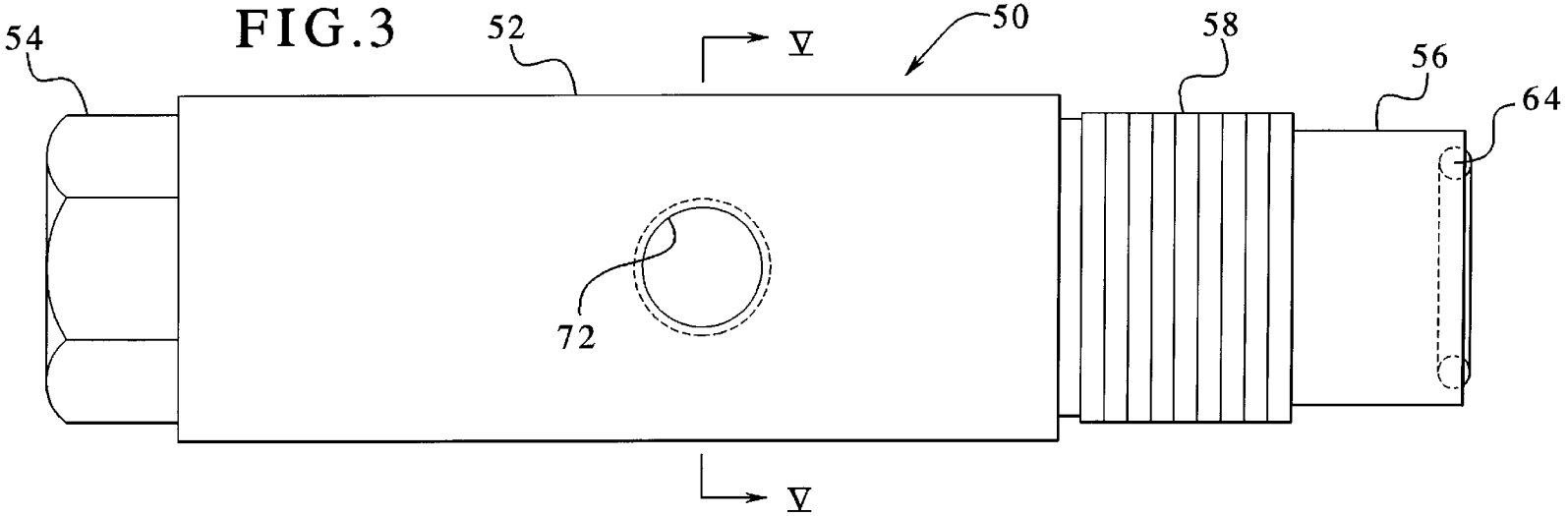
FIG. 3 illustrates a perspective view of a tool housing of the sealed drain tool of FIG. 1.
Figure 4:
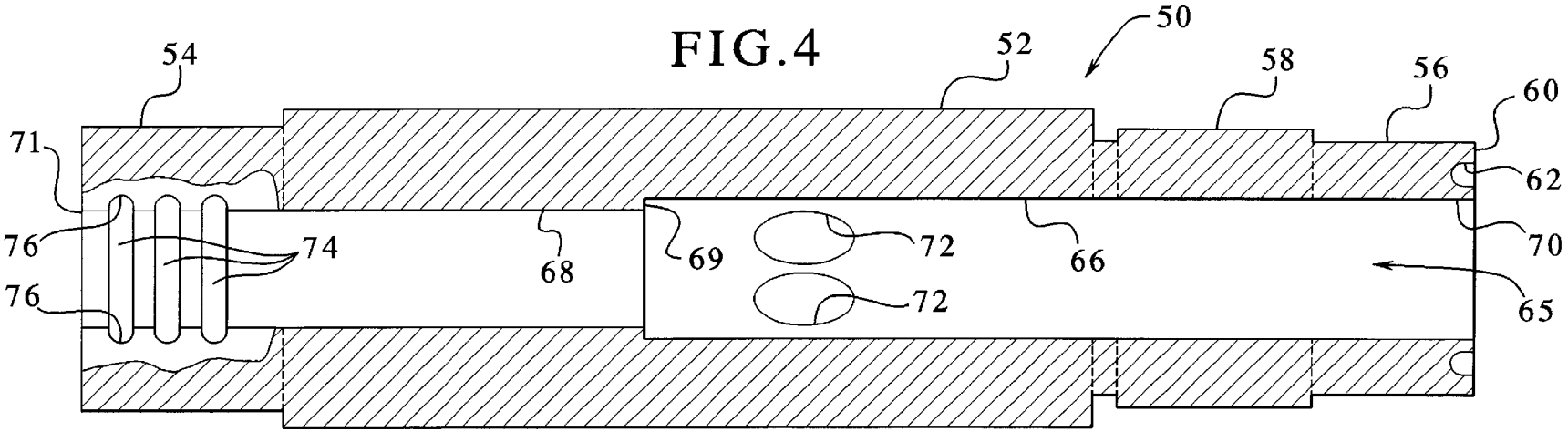
FIG. 4 illustrates a cross sectional view of the tool housing taken along line IV—IV of FIG. 3.

FIGS. 3–6 illustrate a tool housing 50 of the drain tool 20 in more detail. The housing 50 in one embodiment has an exterior cylindrical wall 52 shown in FIGS. 3 and 5 as an elongate circular cylinder. FIG. 4 illustrates the housing 50 in longitudinal cross section in order to show the interior construction of the housing 50. As it will be evident to those skilled in the art, the drain tool housing 50 may take on other forms and constructions other than the circular elongate cylinder as illustrated without departing from the scope of the invention.

Figure 6:
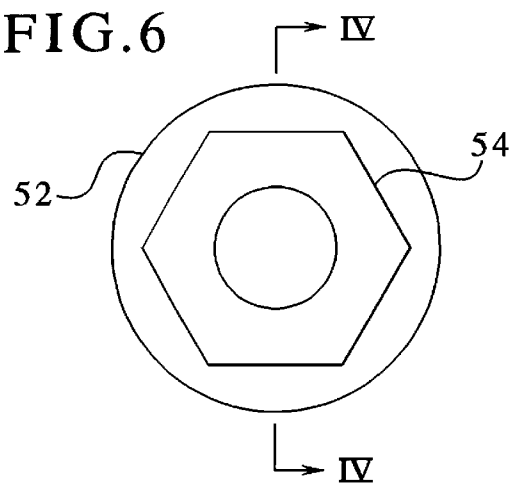
FIG. 6 illustrates an elevational end view of a free end of the housing of FIG. 3.
Figure 5:
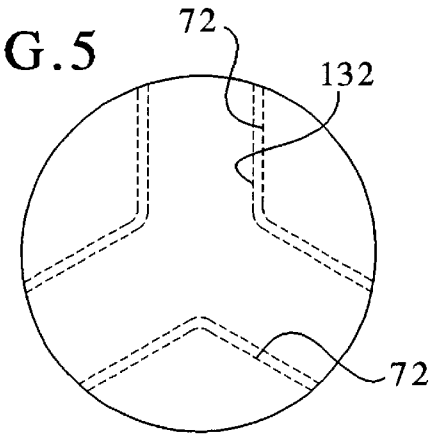
FIG. 5 illustrates a cross sectional view of the tool housing taken along line V—V of FIG. 3.

As shown in FIGS. 3, 5 and 6, the tool housing 50 has a free end including a hex head formation 54 for installing the drain tool 20 as is described below. The tool housing 50 has a mounting end with a smaller diameter cylindrical end portion 56 which is insertable into the pump assembly 22 as is also described below. The mounting end has an externally threaded section 58 disposed between the smaller diameter end portion 56 and the cylindrical exterior surface 52 of the housing 50. The threaded section 58 has a diameter smaller than the exterior surface 52 but larger than the end portion 56. This threaded section 58 is utilized to secure the drain tool assembly 20 in place on the pump 22 as is also described below.

The end portion 56 has a generally planar end face 60 for abutting against a flat surface of the pump assembly 22 when installed. A groove 62 is formed in the planar face 60. An O-ring seal 64 is received within the groove 62 for providing a fluid tight seal between the pump assembly 22 and the end portion 56 as described below.

The tool housing 50 also includes a plunger longitudinal bore 65 extending longitudinally through the entire housing. The bore includes a first bore section 66 of a first diameter extending from the end portion 56. The plunger bore 65 also includes a second bore section 68 of a second diameter extending from the hex head end 54 and meeting the first bore section 66 within the tool housing 50. A shoulder or step 69 is defined by the change in diameter at the juncture between the first and second bore sections 66 and 68 of the bore. The first diameter of the first bore section 66 is larger than the second diameter of the second bore section 68 for reasons described in more detail below. The first bore section 66 defines an inlet opening 70 in the planar end face 60 of the end portion 56. The second bore section 68 defines a free end opening 71 in the free end of the tool housing 50 defined by the hex head end 54.

It is preferred that the plunger bore 65 is machined to a precise diameter and smooth surface finish in order for the invention to function most efficiently. Thus, it is preferred that the tool housing 50 is formed from a material such as steel, aluminum or some adequate alloy in order that it may be precisely machined to include all of the elements in the bore 65.

The tool housing 50 also includes one or more discharge openings 72 illustrated in FIGS. 3 and 5. In one embodiment illustrated in FIG. 5, three discharge openings 72 are provided in the tool housing 50 formed radially into the exterior surface 52 and extending into the first section 66 of the bore 65. Each of the discharge openings 72 are spaced radially 120° apart relative to one another as illustrated in FIG. 5. As will be apparent to those skilled in the art, the number of discharge openings 72, the orientation and position relative to one another, and the orientation and position relative to the tool housing 50 may vary without departing from the scope of the present invention.

Disposed at one end of the second bore section 68 are three O-rings 74 received in annular grooves 76 formed within the bore 65. These O-rings 74 are intended to provide a fluid tight seal around a portion of a plunger assembly as described below and yet permit the plunger to slide within the bore 65 and extend beyond the free end or the hex head end 54 of the tool housing 50. As will be evident to those in the art, the number and positioning of the O-rings 74 and the type of seal used may vary without departing from the scope of the invention.

Figure 7:
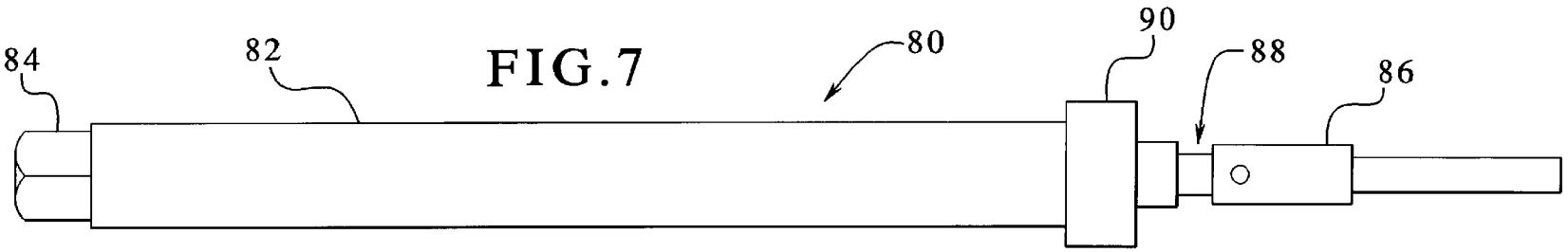
FIG. 7 illustrates a plunger assembly of the sealed drain tool of FIG. 1.

FIG. 7 illustrates a perspective view of a plunger assembly 80 constructed according to one embodiment of the invention. The plunger assembly 80 includes an elongate shaft section 82, a free end having a hex head 84 formed at one end of the shaft, and an engaging tool 86 removably carried on an adaptor end 88 of the shaft. The engaging tool 86 is illustrated in FIG. 8 and its function is described in more detail below.

The plunger assembly 80 includes an annular shoulder section 90 adjacent the adaptor end 88. The diameter of the annular shoulder 90 precisely corresponds with the first diameter of the larger first section 66 of the bore 65. The diameter of the shaft section 82 of the plunger assembly 80 precisely corresponds with the second diameter of the second section 68 of the bore 65. As illustrated in FIG. 2, the hex head end 84 of the plunger assembly 80 is inserted into the tool housing 50 through the inlet opening 70. The length of the plunger assembly 80 is such that the hex head end 84 protrudes from the free end opening 71 of the tool housing 50 as illustrated in FIG. 1 while the engaging tool 86 remains extended from the inlet opening 70. The diameter of the annular shoulder 90 is such that the shoulder will abut against the step 69 in the bore 65 preventing the plunger assembly 80 from traveling any further through the bore 65. Thus, the combination of the annular shoulder 90 and the step 69 within the bore 65 together define one embodiment of a stop element which limits travel of the plunger assembly 80 within the bore 65.

Figure 8:
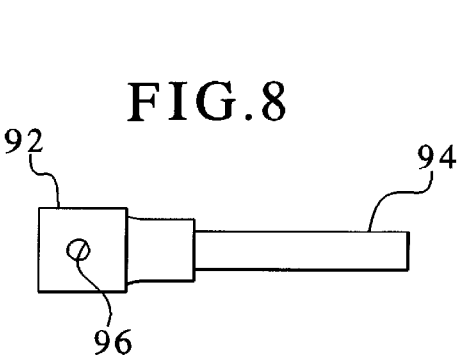
FIG. 8 illustrates a drain plug engaging element attachable to one end of the plunger assembly as illustrated in FIG. 7.

FIGS. 7 and 8 illustrate the engaging tool 86 constructed in accordance with one embodiment of the invention. The engaging tool 86 has an attachment end 92 for insertion over the adaptor end 88 of the plunger 80. The engaging tool 86 also includes a tool end 94 which is adapted to rotationally engage a portion of the drain plug 38 when the tool assembly 20 is inserted. In the present embodiment, the tool end 94 is in the form of an Allen wrench configuration having a hexagonal cross section. The drain plug 38 will include a corresponding hex-shaped recess for receiving the tool end 94 therein, though the drain plug is not shown in detail in these drawings. As will be evident to those skilled in the art, the tool end 94 may take on other tool and fastener configurations and constructions such as, for example, a torx-head arrangement, a screwdriver head arrangement, or a nut and socket arrangement without departing from the scope of the present invention.

Also as illustrated in FIGS. 7 and 8, the attachment end 92 may include a detent opening 96 for engaging a roll pin (not shown) carried on the adaptor end 88 of the plunger 80. Such a configuration permits the engagement tool 86 to snap into place over the adaptor end 88 with a roll pin urged outward into the detent opening 96.

Figure 9:
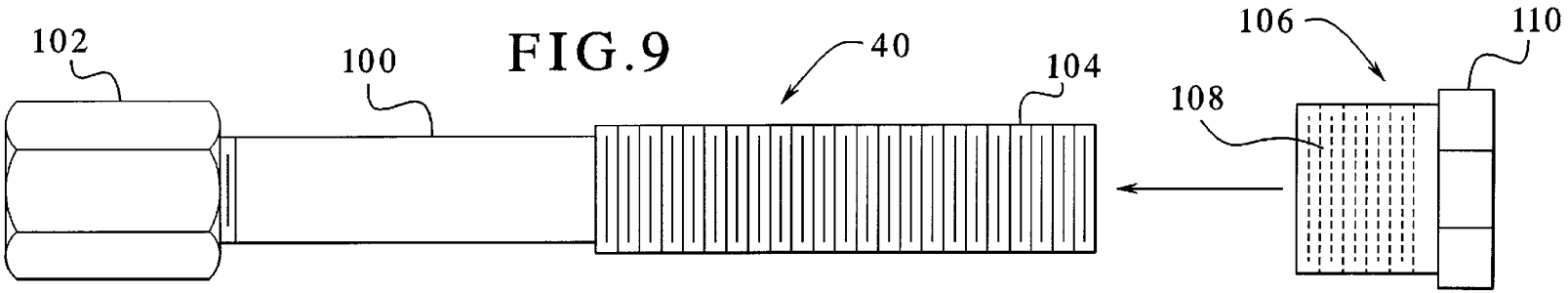
FIG. 9 illustrates a partially exploded view of the alignment device as illustrated in FIG. 2 and constructed in accordance with one embodiment of the present invention.

FIG. 9 illustrates one embodiment of the alignment device 40 originally shown in FIG. 2. The device 40 in the present embodiment includes a elongate shaft 100 having a hex head end 102 at one end and threads 104 formed along a portion of the shaft at the opposite end. A reductor 106 is also illustrated in FIG. 9 for being received over the threaded end 104 of the alignment device 40. The reductor 106 includes internal female threads 108 and a hex head portion 110 at one end. The threads 108 correspond to the threads 104 of the alignment device 40 in order that the reductor 106 threadingly engages the device 40 and moves by relative rotation between the reductor and the device.

As will be evident to those skilled in the art, the alignment device may take on many configurations and constructions but is intended to properly align the rotating case 30 to the stationary housing cover plate 26 so that the sealed drain tool 20 properly aligns with and engages the drain outlet 36 and drain plug 38.

To utilize the sealed drain tool 20 of the invention, the rotating case 30 must be properly aligned with the stationary housing cover plate 26. As illustrated in FIG. 2, the stationary housing 24 includes a drain opening 120 which must be concentrically aligned with the drain outlet 36 of the case 30. The alignment device 40 performs this function. The cover plate 26 of the stationary housing 24 includes an alignment opening 122 which has a hex configuration in cross section for receiving therein the hex section 110 of the reductor 106. The opening 122 also includes a step 124 for preventing the reductor 106 from passing any deeper into the opening 122. Thus, the reductor 106 is held within the opening 122 and prevented from rotating by the corresponding hex configuration of the opening 122 and hex section 110 of the reductor.

The shaft 100 is then inserted and threaded into the reductor 106 via the threaded end 104 until it engages the rotating case 30. The rotating case 30 has a precisely placed threaded opening 126 into which the threaded end 104 of the shaft 100 is received. By aligning the rotating case 30 in this manner, the drain opening 120 and drain outlet 36 between the cover plate 26 and the rotating case 30 will align properly. The hex head end 102 of the device 40 is rotated until the device 40 fully engages the rotating case in order to securely hold the case in proper alignment.

The assembled sealed drain tool 20 shown in FIG. 1 is then positioned over the opening 120 and inserted therein with the engaging tool 86 entering first. The tool end 94 is then inserted into and engages the corresponding opening in the drain plug 38. The housing 50 is then rotated using the hex head end 54 so that the threaded end 58 threads into the opening 120 which has corresponding threads. The housing 50 is threaded into the opening 120 until the flat surface 60 and the O-ring 62 engages a corresponding flat surface a step 128 of the rotating case 30. The housing 50 is rotated further until the O-ring 64 is sufficiently compressed providing a fluid tight seal between the step 128 of the rotating case 30 and the tool 20.

A suitable tool is then placed over the hex head end 84 of the plunger assembly 80 and rotated in order to draw the drain plug out of the drain outlet 36. Once the drain plug 38 releases from the drain outlet 36, the plunger 80 moves rearward toward the free end of the tool housing 50 until the shoulder 90 abuts the step 69 within the bore 65. Fluid passes from the drain outlet 36 to the drain opening 120 and into inlet opening 70 of the bore 65. The fluid exiting the chamber 34 of the pump 22 passes through the bore 65 and exits the openings 72 into a suitable collector which is attached to the drain tool 20 so that no fluid may escape. For example, one or more discharge fittings 130 may be attached to the one or more discharge openings 72 by corresponding threads 132 of the openings 72. The discharge fitting 130 illustrated in FIG. 1 may be tightly connected to a suitable waste container for collecting the drained fluid.

Some fluid may pass between the annular shoulder 90 and the first section 66 of the bore 65 and between the diameter of the shaft section 82 of the plunger 80 and the second section 68. The fluid is prevented from exiting the free end opening 71 of the bore 65 by the multiple seal arrangement illustrated by O-rings 64.

Once the pump assembly 22 is sufficiently drained of fluid, the plunger is forced forward again toward the housing 26. The drain plug 38 is threaded back into the drain outlet 36. In order to ensure that all of the excess fluid is drained from the sealed drain tool 20, a suitable vacuum discharge or vacuum scrubber 134 may be connected to the discharge fitting 130 to completely evacuate the bore 65 prior to releasing the tool 20 from the cover plate 26 of the stationary housing 24.

It should be understood that various changes and modifications to the presently preferred embodiments described herein will be apparent to those skilled in the art. Such changes and modifications may be made without departing from the spirit and scope of the present invention and without diminishing its attendant advantages. It is therefore intended that such changes and modifications be covered by the appended claims.

What is claimed is:

1. A sealed drain tool for a pump having a drain, the drain tool comprising:

a cylindrical tool housing having a mounting end for attaching the tool to the pump, a free end, and a plunger bore extending longitudinally through the housing from the mounting end to the free end, the bore defining an inlet opening at the mounting end for communicating with the drain of the pump and a free end opening;

a plunger slidably received within the bore;

a stop element preventing the plunger from exiting the free end opening of the tool housing;

a fluid seal between the plunger and the bore adjacent the free end; and at least one discharge opening in the tool housing permitting fluid to pass from the drain of the pump into the inlet opening of the bore and to exit the tool housing through the discharge opening.

2. A drain tool according to claim 1, further comprising:

an O-ring in the bore at the free end defining the fluid seal.

3. A drain tool according to claim 1, further comprising:

three adjacent O-rings in the bore at the free end defining the fluid seal between the bore and the plunger.

4. A drain tool according to claim 1, further comprising:

external threads on the tool housing adjacent the mounting end for attaching the tool housing to the pump concentrically with the drain.

5. A drain tool according to claim 1, further comprising:

an engagement tool on the plunger for engaging and removing a drain plug from the drain of the pump.

6. A drain tool according to claim 1, further comprising:

a fluid seal on the mounting end to seal between the pump and the drain tool when attached to the pump.

7. A drain tool according to claim 1, further comprising:

an O-ring on the mounting end providing a fluid seal between the pump and the drain tool when attached to the pump.

8. A drain tool according to claim 1, wherein the plunger further comprises:

an elongate shaft section having a shaft diameter; and an annular shoulder on the shaft having a diameter larger than the shaft diameter.

9. A drain tool according to claim 1, further comprising:

a first bore section of the plunger bore extending from the mounting end of the tool housing and a second bore section of the plunger bore extending from the free end of the tool housing, the first bore section having a larger diameter than the second bore section;

a step formed within the plunger bore where the first and second bore sections join within the tool housing;

an annular shoulder on the plunger, the annular shoulder having a diameter which corresponds to the diameter of the first bore section; and wherein the step within the bore and the annular shoulder on the plunger together define the stop element.

10. A drain tool according to claim 1, wherein the plunger further comprises:

a elongate shaft section having a shaft diameter;

a adapter end at one end of the shaft;

a free end at an opposite end of the shaft;

a hex head formation formed on the free end; and an engagement tool removably carried on the adapter end for engaging an removing a drain plug from the drain of the pump.

11. A drain tool according to claim 1, further comprising:

an engagement tool on the plunger for engaging and removing a drain plug from the drain of the pump, the engagement tool having a tool end of a hexagonal configuration in cross section and attachment end for removably attaching the engagement tool to the plunger.

12. A sealed drain tool for a rotary case pump with a stationary housing having a drain opening and a rotary case having a drain outlet and a drain plug in the drain outlet and wherein the rotary case is rotatably held within the stationary housing, the drain tool comprising:

a cylindrical tube having a threaded mounting end for attaching the tube to the stationary housing of the pump, an O-ring seal on the mounting end for sealing between the stationary housing and the tube, a free end opposite the mounting end, and a plunger bore extending longitudinally through the tube, the bore defining an inlet opening into the tube at the mounting end for communicating with the drain opening of the pump and defining a free end opening at the free end of the tube;

a step formed within the bore;

a plunger slidably received within the bore, the plunger having an elongate cylindrical shaft and an engaging tool carried on one end adapted for engaging and removing the drain plug;

an annular shoulder formed on the shaft which abuts the step preventing the plunger from exiting the tube at the free end opening;

at least one O-ring within the bore adjacent the free end between the shaft of the plunger and the bore; and a discharge opening in the tube permitting fluid to pass from the drain opening of the pump through the inlet opening of the tube and into the bore and to exit the tube through the discharge opening.

13. A rotary case pump comprising:

a stationary housing having a drain opening and an interior cavity;

a rotary case rotatably held within the interior cavity, the rotary case having a drain outlet and a drain plug in the drain outlet;

an alignment device removably attachable to the stationary housing and rotationally aligning and securely holding the drain outlet of the rotary case concentrically relative to the drain opening of the stationary housing;

a cylindrical tool housing having a mounting end removably attached to the drain opening of the pump, a free end, and a plunger bore extending longitudinally through the tool housing from the mounting to the free end;

an inlet opening defined by the bore at the mounting end;

a free end opening defined by the bore at the free end;

a plunger slidably received within the bore;

a stop element preventing the plunger from exiting the free end opening;

a fluid seal between the plunger and the bore adjacent to the free end; and a at least one discharge opening in the tool housing permitting fluid pass from the drain opening of the stationary housing into the inlet opening of the bore and to exit the tool housing through the discharge opening.

14. A method of draining a pump, the pump having a drain opening in a stationary housing and a drain outlet in a rotary case rotatably held within the stationary housing, the method comprising the steps of:

aligning the drain outlet of the rotary case with the drain opening of the stationary housing;

attaching a drain tool to the pump at the drain opening, the tool having a cylindrical tool housing having a fluid discharge in the tool housing and a plunger slidably received within a longitudinal bore of the tool housing;

sealing the housing to the pump;

retreating the plunger within the bore away from the pump to permit fluid to pass from the drain opening of the pump into the bore of the housing and to exit the housing through the discharge.

15. A method according to claim 14, further comprising the steps of:

coupling an engaging tool of the plunger to a drain plug held within the drain outlet of the case; and removing the drain plug by manipulating the plunger.

16. A method according to claim 15, wherein the step of removing the drain plug is done by rotating the plunger which in turn rotates and removes the drain plug prior to the step of retreating the plunger.

17. A method according to claim 14, wherein the step of sealing further comprises:

providing a seal on a mounting end of the housing; and threading the mounting end of the housing into the pump at the drain opening until the seal engages against a surface of the pump.

18. A method according to claim 11 further comprises:

attaching a vacuum scrubber to the discharge opening in order to collect fluid evacuated from the pump.

* * * * *